United States Patent [19]

Emming

[11] Patent Number: 4,827,636

[45] Date of Patent: May 9, 1989

[54] TRENCHER CRUMBER ASSEMBLY

[75] Inventor: Joseph L. Emming, Wichita, Kans.

[73] Assignee: J. I. Case Company, Racine, Wis.

[21] Appl. No.: 160,476

[22] Filed: Feb. 25, 1988

[51] Int. Cl.[4] ..... E02F 5/06

[52] U.S. Cl. ..... 37/86; 37/191 A

[58] Field of Search ..... 37/80 R, 86, 90, 88, 37/87, 89, 191 A, 192 A, 189, 190

[56] References Cited

U.S. PATENT DOCUMENTS

| | | | |
|---|---|---|---|
| 2,654,966 | 10/1953 | Askue | 37/80 R |
| 2,908,091 | 10/1959 | Spring | 37/80 R |
| 3,022,584 | 2/1962 | Meyer et al. | 37/80 R |
| 3,570,152 | 3/1971 | Schuermann et al. | 37/86 |
| 3,932,951 | 1/1976 | Scott et al. | 37/86 |

*Primary Examiner*—Edgar S. Burr
*Assistant Examiner*—Moshe I. Cohen
*Attorney, Agent, or Firm*—Ralph T. Rader

[57] ABSTRACT

A trenching machine including a digging boom rotatably attached to a tractor and a digging chain rotatably mounted on the digging boom wherein a crumber assembly is provided that is rotatable between work and transport positions. The crumber assembly includes a support boom attached to the digging boom, a crumber rotatably attached to the support boom, and an actuator for rotating the crumber. The crumber may be folded toward the support boom so that the digging chain of the trenching machine can be moved into close proximity with a vertical wall, such as a building foundation, thereby minimizing or eliminating the need for manual excavation adjacent to the wall.

4 Claims, 2 Drawing Sheets

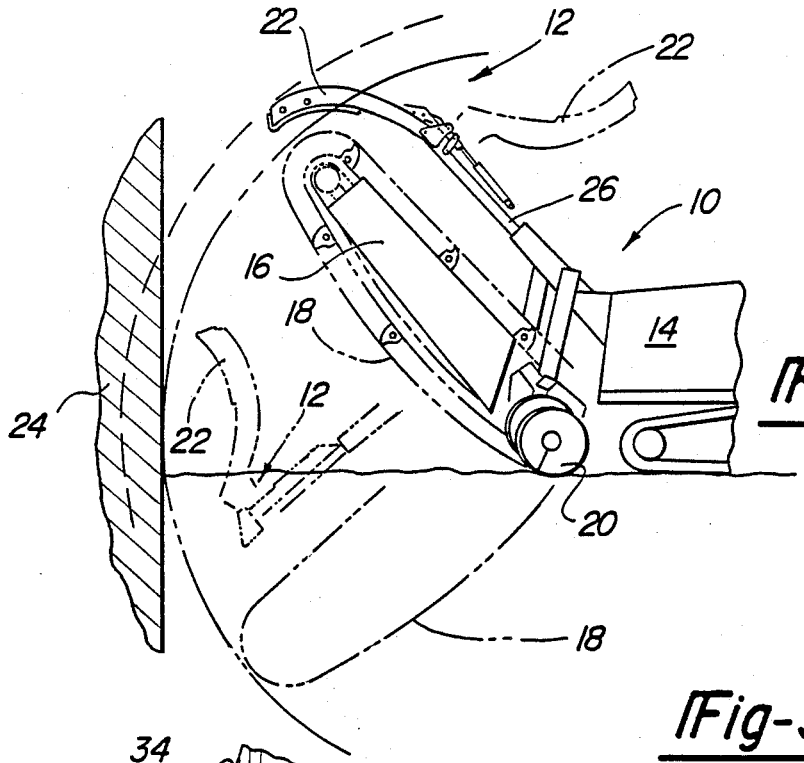
Fig-1
Fig-2
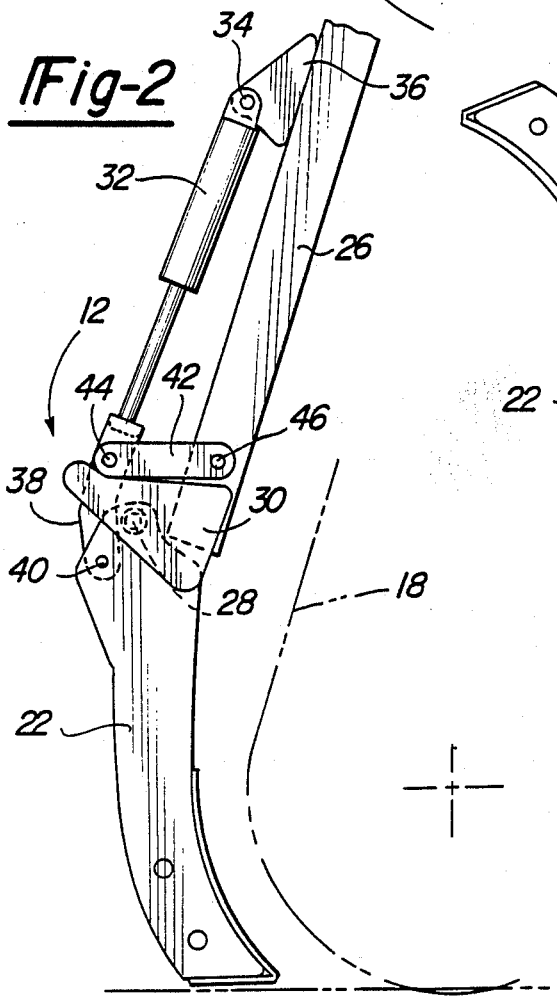
Fig-3
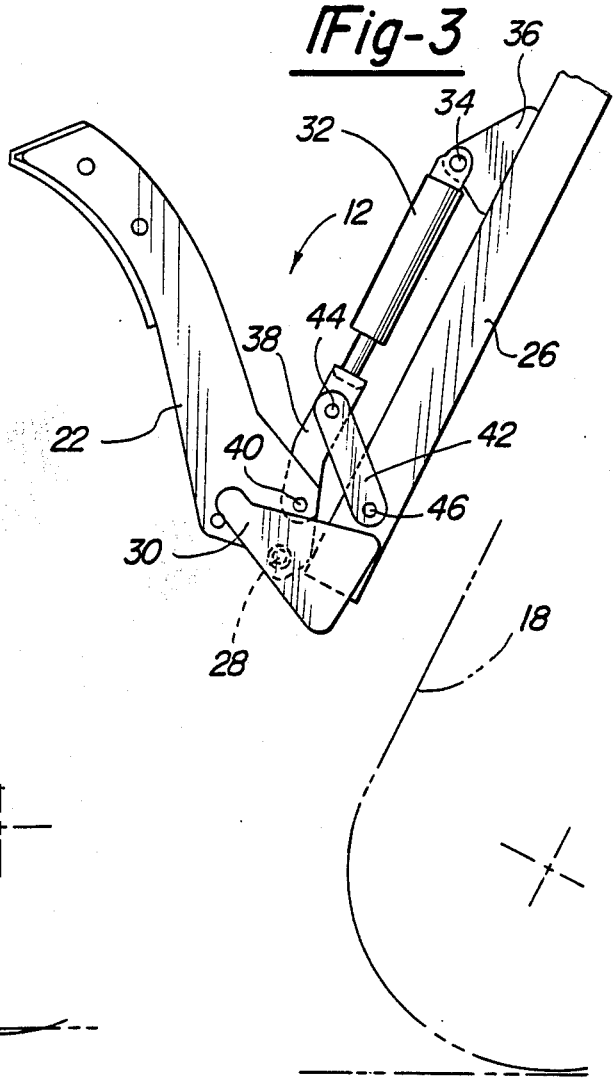

TRENCHER CRUMBER ASSEMBLY

BACKGROUND OF THE INVENTION

The present invention relates to a trenching machine, and more particularly, to an improved crumber assembly for the trenching machine which is foldable so that the digging chain can be moved closer to a wall, thereby minimizing the need for manual excavation adjacent the wall.

It is conventional to provide a trenching machine having a digging boom which is connected to a tractor for pivotal movement. A digging chain is rotatably mounted on the boom and driven for digging in the ground, and an auger is provided which disperses the spoil that is dug during the trenching operation to the sides of the trench. Further, a crumber attachment is normally attached to the trenching boom for cleaning the bottom of the trench during the digging operation.

There is a problem with known trenching machines of the type just described in that the crumber attachment prevents movement of the digging chain to a position in close proximity with a vertical wall, such as a building foundation or a basement wall. Since the digging chain cannot be moved into a position next to the wall, manual excavation is typically required adjacent to the building wall.

Thus, there has been a need for an improved crumber assembly which allows movement of the digging chain into closer proximity with a basement wall or the like. The disadvantages of conventional trenching machines having known crumber attachments have resulted in the improved construction of the present invention which permits movement of the digging chain into close proximity with a wall to minimize or eliminate the need for manual excavation next to the wall.

SUMMARY OF THE INVENTION

The present invention relates to a crumber assembly for a trenching machine that is foldable so that the digging chain can be moved into close proximity with a wall, such as a building foundation. In the disclosed assembly, the crumber is foldable against its supporting boom to permit closer movement of the digging chain with respect to a wall, thereby minimizing or eliminating the need for manual evcavation adjacent to the wall.

The supporting boom for the crumber is connected to the digging boom of the trenching machine as is conventional. The crumber is pivotally attached by a first pin to a member on the end of the crumber supporting boom. A push-pull link is pivotally connected by a second pin to the crumber, and the push-pull link is also connected to an actuating cylinder on the supporting boom. Finally, a guide link is pivotally attached between the supporting boom and push-pull link by a third pin.

The construction of the crumber assembly permits rotational travel of the crumber and also provides substantial mechanical advantage for holding the crumber in both work and transport positions. In the normal work position of the crumber, the second and third pin connections lie in a plane that is spaced to one side of a plane containing the first pin connection. This creates an offset line of force between the push-pull link and the crumber which provides a considerable amount of mechanical advantage to the actuating cylinder for holding the crumber in its work position. The crumber may be rotated into an on-center position by retracting the actuating cylinder and rotating the push-pull and guide links until the three pin connections are in a common plane. In this position, there is no mechanical advantage being provided to the actuating cylinder, and therefore, the cylinder has no effect on the movement of the crumber. Thus, the weight of the crumber causes it to fall over center. If the actuating cylinder is extended slightly after the crumber has fallen over center, the crumber is held in its normal transport position. In this position, the second and third pin connections again lie in a plane that is offset from the first pin connection. As before, this creates an offset line of force from the push-pull link that provides substantial mechanical advantage for the actuating cylinder to hold the crumber in the transport position.

Other advantages and meritorious features of the trencher crumber assembly will be more fully understood from the following description of the invention, the appended claims, and the drawings, a brief description of which follows.

BRIEF DESCRIPTION OF THE DRAWINGS

FIG. 1 is a side elevational view of a trenching machine embodying the crumber assembly of the present invention.

FIG. 2 is a side elevational view of the trencher crumber assembly in its work position.

FIG. 3 is a side elevational view of the trencher crumber assembly in an on-center position.

DESCRIPTION OF THE INVENTION

Figure 4:
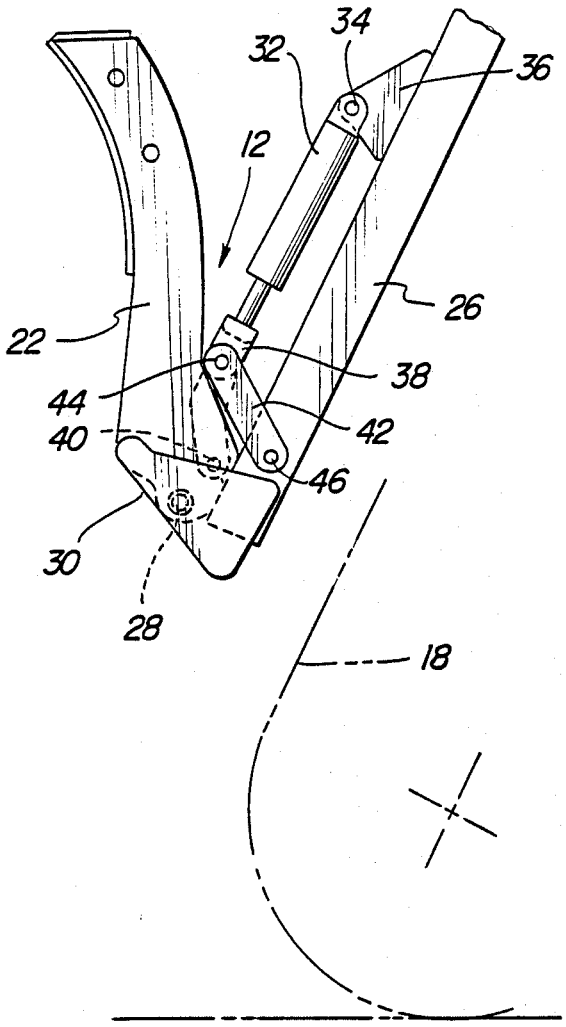
FIG. 4 is a side elevational view of the trencher crumber assembly in a transport or over-center position.

A trenching machine 10 including the improved crumber assembly 12 of the present invention is illustrated in FIGS. 1–4.

The trenching machine 10 shown in FIG. 1 is seen to include a tractor 14 and a digging boom 16 which is pivotally mounted to the tractor. As is conventional, a digging chain 18 is rotatably mounted to the trenching boom 16 for digging in the ground. Further, an auger 20 is provided which disperses the spoil that is dug during the trenching operations to the sides of the trench.

The present invention relates to the crumber assembly 12 that is attached to the trenching boom 16. As is conventional in trenching machines, a crumber 22 is provided for cleaning the bottom of the trench during the digging operation. In the disclosed construction, the crumber 22 may be folded back so that the digging chain 18 can be moved into close proximity with a wall, such as the building foundation wall 24 shown in FIG. 1. Thus, as shown by the solid and phantom line positions for crumber 22 in FIG. 1, crumber 22 is foldable against its supporting boom 26 to permit the movement of digging chain 18 into close proximity with respect to wall 24, thereby minimizing or eliminating the need for manual excavation adjacent wall 24.

The supporting boom 26 for crumber 22 is connected to digging boom 16 as is conventional. Crumber 22 is pivotally attached by pin 28 to member 30 on the end of supporting boom 26. The location of pin connection 28 is important to the operation of the crumber assembly 12, as will be described. An actuating cylinder 32 is connected at one end by pin 34 to lugs 36 extending from boom 26. The rod end of cylinder 32 is connected to a push-pull link 38 which, in turn, is pivotally connected by pin 40 to crumber 22. Finally, guide link 42 is pivotally attached at its opposite ends by pins 44 and 46 to push-pull link 38 and boom 26, respectively.

As will hereinafter be described, the construction of crumber assembly 12 permits rotational travel of crumber 22 and also provides a substantial mechanical advantage for holding crumber 22 in both work and transport positions.

FIG. 2 illustrates crumber 22 in a normal work position. In this position, pins 40 and 44 lie in a plane that is spaced to one side of a plane containing pin 28. This creates an offset line of force for push-pull link 38 which provides a considerable amount of mechanical advantage to actuating cylinder 32 for holding crumber 22 in a work position.

FIG. 3 illustrates a position where cylinder 32 has been retracted for rotating links 38 and 42 until pins 28, 40, and 44 are in a common plane. This is an on-center position where there is no mechanical advantage being provided to cylinder 32, and therefore, cylinder 32 has no effect on the movement of crumber 22. In this position, the weight of crumber 22 causes it to fall over center.

FIG. 4 illustrates a normal transport or over-center position where cylinder 32 is extended slightly after crumber 22 has fallen over center, as previously described. In this position, pins 40 and 44 lie in a plane that is again spaced from a plane containing pin 28. However, by comparing FIGS. 2 and 4, it is apparent that pins 40 and 44 lie on opposite sides of pin 28 when crumber 22 is in its work and transport positions. As before, this creates an offset line of force for push-pull link 38 that provides a substantial mechanical advantage for actuating cylinder 32 to hold crumber 22 in position.

The crumber 22 may be moved from a transport to a work position by lowering the digging boom 16 from its solid line position in FIG. 1 to an angle approximately 30 degrees below horizontal and reversing the steps just described.

Thus, the disclosed crumber assembly 12 is foldable to various positions for work and transport. Further, when the crumber is folded against its supporting boom, the digging chain 18 may be moved into close proximity to a wall 24, thereby minimizing or eliminating the need for manual excavation adjacent to the wall. Moreover, the disclosed construction provides mechanical advantage to the actuating cylinder 32 for holding the crumber in either its work or transport positions.

It will be apparent to those skilled in the art that the foregoing disclosure is exemplary in nature rather than limiting, with the invention being defined by the appended claims as follows.

What is claimed is:

1. A trenching machine including a digging boom rotatably attached to a tractor and a digging chain rotatably mounted on said digging boom, the improvement comprising:

a crumber assembly attached to the digging boom, said crumber assembly including a support boom attached to said digging boom and a crumber rotatably attached to said support boom for rotation about a first connection point, actuator means connected to said support boom and pivotally connected to said crumber at a second connection point, and guide means connected to said support boom and pivotally connected to said actuator means at a third connection point; and said crumber rotatable between a work position, an on-center position, and an over-center transport position, said second and third connection points being aligned when said crumber is in its work and transport positions whereby a line of force is formed between said second and third connection points that is offset from said first connection point and said offset line of force providing mechanical advantage to said actuator means for holding said crumber in either a work or transport position, and wherein said first, second, and third connection points are aligned when said crumber is rotated to its on-center position whereby the line of force between said second and third connection points has no effect on the movement of said crumber thereby permitting said crumber to fall over center.

2. The trenching machine as defined in claim 1 wherein said actuator means includes a push-pull link connected to said crumber at said second connection point.

3. The trenching machine as defined in claim 2 wherein said guide means is connected to said push-pull link at said third connection point.

4. The trenching machine is defined in claim 1 wherein said first connection point is offset from the longitudinal axis of said support boom.

* * * * *